United States Patent [19]

Conlon et al.

[11] Patent Number: 4,632,855

[45] Date of Patent: Dec. 30, 1986

[54] HEAT-RESISTANT ROLL AND METHOD OF MAKING SAME

[76] Inventors: Thomas J. Conlon, P.O. Box 398, Natick, Mass. 01760; William J. Leahy, P.O. Box 951, Cotuit, Mass. 02635

[21] Appl. No.: 737,327

[22] Filed: May 23, 1985

[51] Int. Cl.[4] ..... H05B 1/00

[52] U.S. Cl. ..... 428/36; 428/451; 29/132; 219/543

[58] Field of Search ..... 106/287.11; 428/35, 428/451, 446, 909, 357; 29/132; 219/469, 543

[56] References Cited

U.S. PATENT DOCUMENTS 3,686,731 8/1972 Koori et al. ..... 29/132
3,912,901 10/1975 Strella et al. ..... 219/216
4,034,189 7/1977 Sakamaki et al. ..... 219/216
4,148,937 4/1979 Kurachi et al. ..... 427/194
4,505,573 3/1985 Brewington et al. ..... 29/132

*Primary Examiner*—John E. Kittle
*Assistant Examiner*—James J. Seidleck
*Attorney, Agent, or Firm*—Cesari and McKenna

[57] ABSTRACT

The useful life expectancy of an RTV roll for use especially in the fuser of a copying machine is increased considerably by applying a silazane resin polymer coating to the surface of the roll and heating the coated roll to an elevated temperature sufficient to cure the resin and bond it to the roll surface so that it forms a flexible adhesive covering on the roll which minimizes the adherence to the roll of toner particles and copy paper.

7 Claims, 2 Drawing Figures

HEAT-RESISTANT ROLL AND METHOD OF MAKING SAME

This invention relates to a heat-resistant roll. It relates more particularly to an improved roll structure especially adapted for use in the fusing station of a copying system.

BACKGROUND OF THE INVENTION

In the process of electrographic recording, a light image of an original document to be copied is recorded as a latent electrostatic image on a photoconductive member. That latent image is developed or made visible by the application of electroscopic particles or toner to the photoconductive member. The developed image may be fixed either directly upon that member or it may be transferred from that member to a recording medium and fixed to that medium. In the latter process, called transfer xerography, the recording medium is usually a plain paper sheet. Since electrographic copiers are usually of this type, we will describe the invention in that context.

In transfer xerography, the paper sheet or other recording medium carrying the developed image from the photoconductive member is routed to a fusing station in order to fuse the toner particles to the paper by the application of heat and pressure. Invariably, this involves advancing the sheet into the nip between a fuser roll and a pressure or back-up roll. The fuser roll is heated internally or externally so that its surface temperature at the nip is sufficient to fuse the toner particles to the paper sheet. The sheet carrying the fixed image is then advanced to the exit end of the copying machine.

Usually, the pressure roll in an electrographic copy machine comprises a rigid core having a resilient outer cover composed of a heat-resistant elastomeric material such as polytetrafluorethylene or room temperature vulcanizable silicone rubber (RTV).

The fuser roll which cooperates with the back-up roll to fix the toner to the paper sheet is similarly constructed with a rigid core and a cover of heat-resistant elastomeric material such as RTV. Sometimes, the fuser roll also carries an outer film of an abhesive material such as silicone oil. The oil is wiped onto the outer surface of the roll as the roll turns in the machine to inhibit the offsetting of toner from the paper sheet to the roll and to reduce the tendency of the paper to stick to the roll. Typical prior fuser and back-up rolls of this general type are disclosed, for example, in U.S. Pat. Nos. 4,372,246; 4,071,735; 3,967,042; 3,912,901 and 3,452,181.

Conventional fuser and back-up rolls, including even those provided with abhesive surface coatings or layers are disadvantaged in that they have relatively short useful lives. Over time, the heat generated at the fusing station, which may reach 175° C. at the surface of the fuser roll, adversely affects the rolls there. The roll surfaces tend to deteriorate so that the printing produced on the recording medium becomes uneven and irregular in both geometry and color or blackness. In time, the surface of the fuser roll becomes degraded to the extent that toner adheres to the roll surface and often even the paper sheet itself adheres to and wraps around the fuser roll causing a paper jam. In that event, the machine usually has to be shut down and the jam relieved manually. This tends to be a tedious and time-consuming process and a source of operator annoyance.

In practice, then, the end of the useful life of a roll occurs when the copy machine suffers frequent jams with the paper wrapped around the roll. It is well recognized in the industry that the available RTV rolls lose their ability to release the fused toner and paper after about 50,000 copies. This is often referred to in the manufacturers' literature as the normal replacement period of operation for such rolls.

It would be desirable therefore if there were available rolls and rollers for use particularly at the fusing station of copying machines that could withstand the high temperatures present in that operating environment in order to prolong the lives of the rolls and to minimize machine downtime.

SUMMARY OF THE INVENTION

Accordingly, the present invention aims to provide an improved heat-resistant roll.

Another object of the invention is to provide a roll or roller capable of withstanding high temperatures for a relatively long period of time, making it especially suitable for use at the fusing station of an electrographic copying machine or system.

A further object of the invention is to provide a roll for use especially at a copying machine fusing station which is able to perform its toner fixing function effectively for a prolonged period of time.

Still another object of the invention is to provide a roll for use at a copying machine fusing station which minimizes machine downtime.

Another object of the invention is to provide a process for treating a conventional roll of the type used at the fusing station of a copier system which extends the useful life of that roll.

Yet another object of the invention is to provide a method of making a roll for a copier fusing station which is very resistant to the heat developed there.

A further object of the invention is to provide a method of making a roll of this general type which remains abhesive to toner particles and paper for a prolonged period.

Other objects will, in part, be obvious and will, in part, appear hereinafter.

The invention accordingly comprises the several steps and the relation of one or more of such steps with respect to each of the others, and the article possessing the features, properties and the relation of elements which are exemplified in the following detailed description, and the scope of the invention will be indicated in the claims.

Briefly, we have found that the useful life of the rolls used at the fusing station of a copying machine or system may be increased drastically by providing the rolls with an outer coating or layer of a silazane resin polymer and then heating the coated roll to a temperature sufficient to cure that coating on the roll. After curing, the resin coating becomes firmly bonded to the surface of the roll and yet is still flexible so that it does not tend to separate from the roll.

The coated roll produced in this fashion is abhesive to toner particles and is able to fix high quality images to recording media including ordinary paper. Moreover, the copy paper itself does not tend to adhere to or wrap around the roll. Resultantly, the roll has an operating life that is much longer than the useful lives of conventional rolls of this general type. Yet our improved roll is not appreciably more expensive to make than the prior rolls which do not possess these advantages. The present invention can even be practiced on otherwise conventionally manufactured rolls used for this purpose so as to improve the operation of those rolls and to extend their useful lives. As a direct result of using the present rolls at their fusing stations, standard copying systems suffer less downtime due to paper jams, roll replacement and other such maintenance than the copiers outfitted with fuser and back-up rolls of conventional construction.

BRIEF DESCRIPTION OF THE DRAWING

For a fuller understanding of the nature and objects of the invention, reference should be had to the following detailed description, taken in connection with the accompanying drawing, in which.

DETAILED DESCRIPTION OF THE PREFERRED EMBODIMENT

Figure 1:
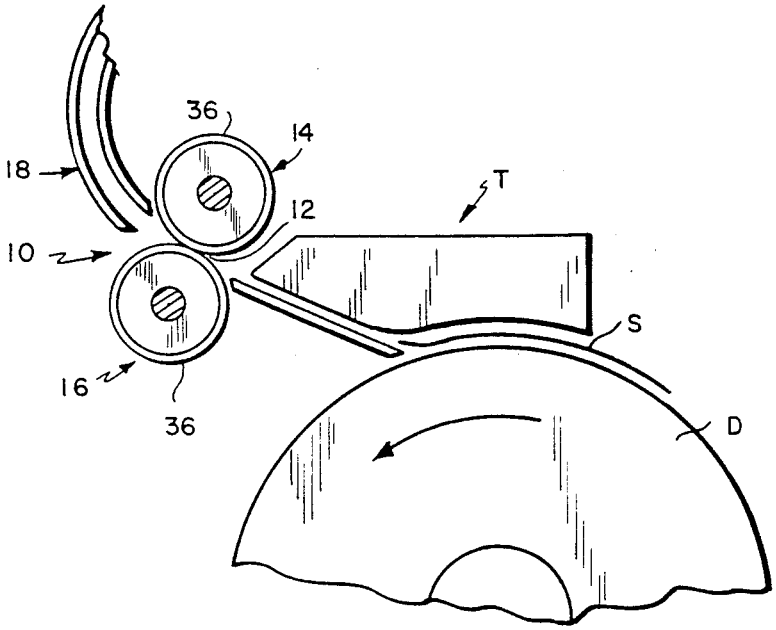
FIG. 1 is a fragmentary schematic view of the fusing station section of a conventional electrographic copying machine incorporating fuser and back-up rolls made in accordance with this invention.

Referring to FIG. 1 of the drawing, the photoconductive drum D of a conventional xerographic copying machine can acquire an electrostatic image which may be developed by the application of toner particles to the drum surface to form powder images in the configuration of the copy being reproduced. At a transfer station shown generally at T, the powder image is transferred to a recording medium such as a paper sheet S. The sheet is then advanced to a fusing station shown generally at 10 where it passes through the nip 12 created by the engagement of a fuser roll 14 with a pressure or back-up roll 16.

The fuser roll is heated either externally or internally to an elevated temperature which, along with the pressure at the nip 12, is sufficient to cause the toner particles to adhere or fuse to the surface of sheet S. A typical fusing station 10 operates at a roll 14 surface temperature in the order of 175° C. or higher and a nip pressure of 2 to 8 psi. As is well known in the art, station 10 may also include a pad or blade (not shown) supplied with silicone oil for wiping the oil onto roll 14 (and maybe also roll 16) to inhibit offsetting of toner to the roll; the pad also cleans excess toner from the roll. Upon leaving the nip 12, the sheet S carrying the fixed image is guided away from the rolls by a stripper 18 and advanced to the exit end of the copying machine.

Figure 2:
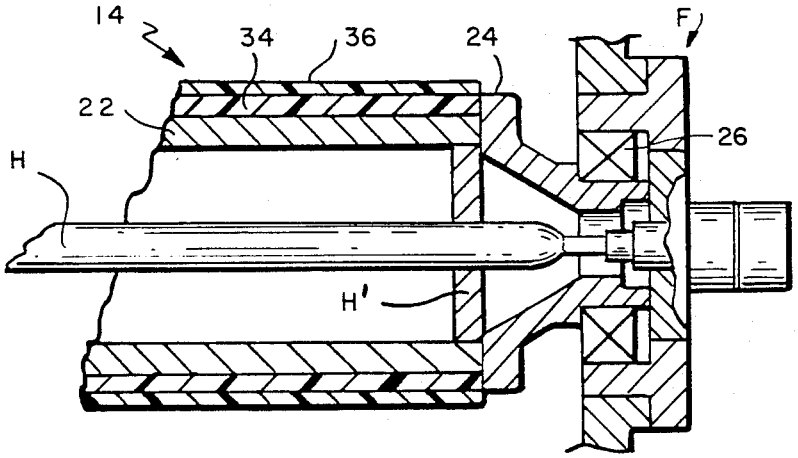
FIG. 2 is a fragmentary longitudinal sectional view of one of the rolls in FIG. 1.

Refer now to FIG. 2 which illustrates in greater detail the construction of the fuser roll 14. As shown there, it comprises a rigid tubular core 22 made of steel, aluminum or other strong material. Mounted to each end of core 22 is a generally frustoconical end cap 24 whose outer end is journaled by way of a bearing unit 26 to the copying machine frame F. The roll 14 is heated internally by a quartz lamp H which is supported at the longitudinal axis of roll 14 by annular end supports H' located inside core 22. The heater H is connected by appropriate electrical leads (not shown) to an external power source. Roll 14 could, of course, also be heated by well known external means, in which case the heater H and its support H' would be omitted.

The surface of core 22 is coated or covered with a layer 34 of a heat-resistant resilient material such as RTV. Typically, this layer has a thickness of about 60 mils. An RTV covered roll can be made conventionally by the technique disclosed in U.S. Pat. No. 4,372,246, for example. Alternatively, finished RTV rolls are available in present-day copying machines such as those marketed by Savin Corporation under its Model No. 5020. One standard RTV material suitable for layer 34 is a condensation vulcanized polymer having the following general composition:

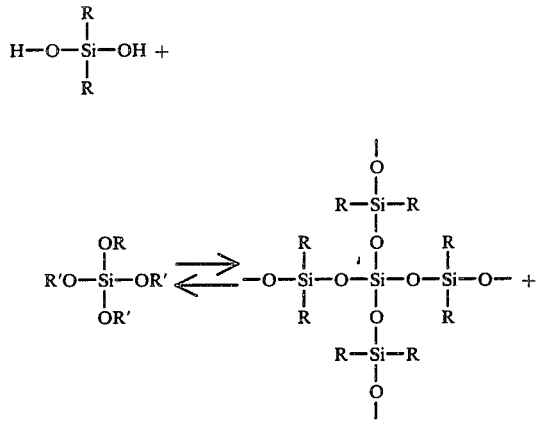

4R'OH where R is an organic group such as $CH_3$ or $CH_2$. There is linkage of four siloxane chains through reaction of the terminal hydroxyl groups with a silicic acid ester with the formation of the decomposition product R'OH, where OH is the terminal hydroxyl group and R' is an organic radical, e.g., ethyl alcohol. The reaction takes place in the presence of a catalyst which is usually an organot-in compound.

In accordance with this invention, there is present on the outer surface of the RTV roll, a thin, e.g., 0.1 to 0.3 mil, coating or layer 36 of a cured silazane polymer resin which is applied to layer 34 in a manner to be described later.

The silazane resin coating applied in liquid form to the RTV roll has the following general composition:

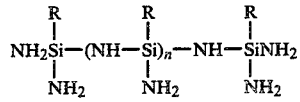

where R is an aliphatic or aromatic radical such as a methyl or ethyl group. The coating resin reacts with the silicone rubber and when the coated roll is cured, typically at a temperature in excess of 70° C. for at least 10 minutes, the resin cures to a flexible resilient material bonded tightly to layer 34 and whose composition may be expressed generally as follows:

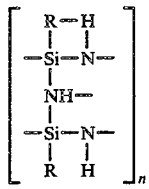

The pressure or back-up roller 16 in fuser 10 has more or less the same construction as roll 14 except that the RTV layer typically has a thickness of ¼ to ⅜ inch.

Sometimes to add resiliency to the back-up roll, an underlayer (not shown) is included between core 22 and the RTV layer 34. One such underlayer disclosed in U.S. Pat. No. 4,372,246 consists of a fluoroelastomeric foam. Also, of course, the pressure roll 16 does not require the heater H or its supports H'.

Using rolls 14 and 16 made in accordance with this invention in fusing station 10 of the copy machine illustrated in FIG. 1, the number of high quality copies that can be made by the copier before machine failure is three or even more times the number that can be made using presently available rolls at the fusing station. When the surface of the RTV roll carries the cured silazane resin layer 36, the roll outer surface does not become degraded appreciably over time. Resultantly, toner particles do not tend to adhere to the surface of the fuser roll and the color quality and geometry of the images applied to the paper sheets S remains quite good. Furthermore, the sheet S itself does not tend to wrap around the fuser roll even after many copies have been made so that the copying machine suffers fewer paper jams. Resultantly, the normal roll replacement period of operation of the copying machine is extended substantially so that there is less machine downtime and more throughput. The efficacy of this invention will become even more evident from the following examples.

In these examples, the tests were run on a standard Savin Model No. 5020 office copying machine which normally operates with standard RTV fuser and pressure rolls. The copy paper is standard white copy paper available from Carter Rice, Boston, Mass. The consummables employed in the test such as the toner, the silicone oil wiped onto the rolls and the wiping pads therefor were obtained from the machine distributor. The test machine was set up to operate as it would in a normal office environment.

EXAMPLE 1

The standard fuser and back-up rolls for the test copier were placed in an oven at 70° C. for 15 minutes. With each roll at this temperature, a coating of silazane resin polymer consisting of 1.5% solids in a solvent consisting of dibutyl ether 41%, aliphatic mineral spirits 55.8% and ethylene glycol dimethyl ether 1.7% was wiped generously onto the surface of the RTV roll and the roll returned to the oven for 10 minutes. Two additional coats of resin polymer were applied to each roll in the same manner. Then the thrice-coated rolls were placed in the test machine and the machine set for continuous operation. In this example, 166,000 copies were made before the machine jammed due to a paper sheet wrapping around the fuser roll. This compares with the manufacturer-advertized normal replacement time for these rolls which is about 50,000 copies as noted above.

EXAMPLE 2

A set of standard Savin replacement fuser and back-up rolls were stripped of their RTV layers down to their metal cores. The cores were sanded and solvent washed to provide clean dry surfaces. To each of these cores was applied a light uniform coat of Primer YP9327 obtained from Toshiba Silicones, Tokyo, Japan. The primer coating was allowed to cure at room temperature (21° C.) for 30 minutes. Each primed core was then placed in a standard roll mold and a sufficient quantity of degassed Toshiba Silicones RTV component 3503A catalyzed with component 3503B was poured in to fill each mold. After curing for 24 hours at room temperature, the fuser roll was ground to the standard size of 1.57 inches and the pressure roll was ground to the standard 2.0 inch size, using a grinding wheel. Final smoothing was accomplished with a 180 grit sandpaper. These untreated rolls were then placed in the Savin test machine set for continuous operation. The machine jammed after 52,000 copies due to a paper sheet being wrapped around the fuser roll.

EXAMPLE 3

Another pair of rolls was made exactly as described above in Example 2. To each of these rolls were applied three coats of the 1.5% solids silazane resin polymer as described above in Example 1. The rolls were placed in the test copier set for continuous operation. In this test 178,000 copies were made before a failure occurred because the fingers of the stripper 18 contacted the fuser roll and scored its layer 26 so that corresponding marks appeared on subsequent copies.

EXAMPLE 4

A second pair of rolls were made and coated in the same manner described above in Example 3. When the test copier was run with these rolls, 160,000 copies were made before a failure occurred due to the same cause stated in Example 3.

EXAMPLE 5

A pair of standard Savin replacement fuser and back-up rolls were stripped, sanded and washed as described above in Example 2. A thin uniform coat of Dow Corning Primer No. 1200 available from Dow Corning Corporation, Midland, Mich. was then applied to the surface of each core. After solvent evaporation at room temperature for 30 minutes, the coated cores were placed in an oven maintained at 100° C. for 10 minutes. Then each core was placed in a mold and a sufficent quantity of degassed Dow Corning Silastic RTV 3110 with Dow Corning Catalyst No. 1 was poured into each mold. After curing for 24 hours at room temperature, each RTV roll was ground to size and polished as described above in Example 2. Then each roll was given three coats of 1.5% solids silazane resin polymer as described above in Example 1. Following this, each coated roll was placed in an oven maintained at 100° C. for one hour. The polymerization reaction of the Dow Corning RTV in this example goes in the other direction. Accordingly, in order to prevent depolymerization of the RTV layer 34 on the roll, each hour thereafter, the oven temperature was raised 25° C. until the oven temperature reached 200° C. and then the rolls were maintained at that 200° C. temperature for two hours. Following this treatment, the two rolls were placed in the test machine. The copier made 92,000 copies before a failure occurred due to the stripper fingers contacting the fuser roll and scoring its layer 36 so that corresponding marks appeared on subsequent copies. As in Examples 3 and 4, the failure had nothing to do with deterioration of the rolls due to the heat at the fusing station.

It will be seen from the foregoing, then, that an RTV roll which has been coated with a silazane resin polymer and cured as described above has a drastically increased useful life when used as the fuser or back-up roll in a copying machine or system. The roll is able to withstand the elevated temperature present at the fusing station for a prolonged period of time without its surface degrading to the extent that toner particles or the copy medium adheres to that surface. Resultantly, the use of these treated rolls minimizes the incidence of paper jams in the machines and the attendant machine downtime and operator annoyance.

The heat-resistant rolls described herein can also be used in other types of copying systems which develop and fix images by fusing particles to a copy medium such as paper. For example, there now exist copiers which acquire and store latent images on magnetic medium similar to a magnetic tape or disk. The images are developed by ferromagnetic toner particles which are transferred and fused to the copy medium at a fusing station in much the same way as described above. Since these fusing stations also operate at high temperatures (e.g., 155° C.), such systems equipped with our heat-resistant rolls should have the same advantages discussed above.

Also, while we have described the present invention as applied to a fuser or back-up roll in a copying system, the invention has equal application to rolls and surfaces used in other apparatus such as paper calendars, printers, and other web-handling apparatus where the offsetting of material from a web or adhesion of the web itself to the roll or surface may be a problem. Also, while the invention has been tested on condensation vulcanized RTV rolls specifically, it should be applicable also to rolls covered with addition cured RTV compounds and so-called one-part RTV compounds and equivalent materials.

It will thus be seen that the objects set forth above, among those made apparent from the preceding description, are efficiently attained, and, since certain changes may be made in the above method and in the above construction without departing from the scope of the invention, it is intended that all matter contained in the above description or shown in the accompanying drawing be interpreted as illustrative and not in a limiting sense.

It is also to be understood that the following claims are intended to cover all of the generic and specific features of the invention herein described.

What is claimed as new and desired to be secured by Letters Patent of the United States is:

1. A roll of the type having a core and a heat-resistant elastomeric cover on the core, said roll being characterized by a flexible silazane resin polymer coating reacted with and bonded to said cover.

2. The roll defined in claim 1 wherein said cover comprises an RTV silicone rubber.

3. The roll defined in claim 2 wherein said silazane resin polymer coating comprises:

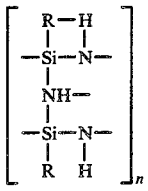

4. The method of extending the useful performance life of an RTV silicon rubber covered roll comprising the steps of coating the surface of said roll with a silazane resin polymer in liquid form and maintaining said coated roll at a temperature sufficient to cause said resin to react with and bond to the roll surface while curing thereby to form a flexible abhesive heat-resistant coating on the roll surface.

5. The method defined in claim 4 wherein said coating is composed of at least 1.5% resin solids.

6. The method defined in claim 5 wherein said coated roll is maintained at a curing temperature in excess of 60° C. for at least 10 minutes.

7. A silicone rubber roll with a flexible, heat-resistant surface formed by coating the silicone rubber with a silazane resin polymer in liquid form and curing the polymer in situ so that it reacts with and bonds to the silicone rubber at the roll surface.

* * * * *